US006755025B2

(12) United States Patent
Eleftheriou et al.

(10) Patent No.: US 6,755,025 B2
(45) Date of Patent: Jun. 29, 2004

(54) PNEUMATIC COMPRESSOR BLEED VALVE

(75) Inventors: Andreas Eleftheriou, Woodbridge (CA); Vittorio Bruno, Mississauga (CA); Ian William Chandler, Georgetown (CA)

(73) Assignee: Pratt & Whitney Canada Corp., Longueuil (CA)

( * ) Notice: Subject to any disclaimer, the term of this patent is extended or adjusted under 35 U.S.C. 154(b) by 46 days.

(21) Appl. No.: 10/200,461

(22) Filed: Jul. 23, 2002

(65) Prior Publication Data

US 2004/0016238 A1 Jan. 29, 2004

(51) Int. Cl.[7] ..... F02C 9/18
(52) U.S. Cl. ..... 60/795
(58) Field of Search ..... 60/785, 39.23, 60/795; 415/157

(56) References Cited

U.S. PATENT DOCUMENTS 3,030,006 A 4/1962 Shoup et al.
3,057,541 A 9/1962 Hasbrouck et al.
3,094,270 A 6/1963 Kent et al.
3,994,617 A * 11/1976 McCombs ..... 415/28
4,409,788 A * 10/1983 Nash et al. ..... 60/226.3
4,463,552 A 8/1984 Monhardt et al.
4,499,731 A 2/1985 Moser
4,715,779 A 12/1987 Suciu
4,827,713 A 5/1989 Peterson et al.
5,380,151 A 1/1995 Kostka et al.
6,122,905 A 9/2000 Liu
6,161,839 A 12/2000 Walton et al.
6,438,941 B1 * 8/2002 Elliott et al. ..... 60/226.1

FOREIGN PATENT DOCUMENTS

GB 9115350 11/1962

* cited by examiner

*Primary Examiner*—Ehud Gartenberg
(74) *Attorney, Agent, or Firm*—Ogilvy Renault

(57) ABSTRACT

A pneumatically operated compressor bleed valve communicating between a compressor housing and a bypass duct of a gas turbine engine. The valve has an annular piston slidably mounted within an annular chamber concentric the longitudinal engine axis. An annular valve plug on the piston and an annular valve seat on the compressor housing defining a valve seal interface. A control air pressure conduit communicates between a portion of the annular chamber bounded by the piston and a source of control air pressure. Guide bearings mounted to the periphery of the piston and the housing have a helical guide surface concentric the engine axis.

14 Claims, 3 Drawing Sheets

PNEUMATIC COMPRESSOR BLEED VALVE

TECHNICAL FIELD

The invention relates to a pneumatically operated sleeve-type compressor bleed valve for a gas turbine engine supported with guide bearings to operate in a helical path.

BACKGROUND OF THE ART

Gas turbine engines often include a low-pressure compressor stage and a high-pressure compressor stage for pressurizing ambient air as it flows through the compressor flow path to the combustor and turbines. Under certain operating conditions it is necessary to moderate the air pressure at the discharge end of the compressor to address aerodynamic instabilities such as compressor stall or surge. In order to moderate the pressure it is conventional to open a compressor bleed valve that directs a portion of the pressurized air from the compressor flow path into a lower pressure region such as the bypass gas path or external ambient air.

U.S. Pat. No. 6,122,905 to Liu describes a conventional compressor bleed valve that is mounted rigidly through the engine to discharge flow from the compressor into a narrow area within the bypass flow duct. This pneumatic side valve arrangement is suitable for turboprop or turbo shaft engines since compressed air is exhausted directly to the ambient air flow. However in fan engines with bypass ducts, the valve protrudes through the bypass duct and concentrates the compressor discharge air flow in a narrow area within the bypass duct flow. The injection of additional compressed air into the bypass duct within a limited flow area creates airflow variations, and the location in the bypass duct partially obstructs the bypass flow.

An alternative bleed valve is shown in U.S. Pat. No. 6,161,839 to Walton et al. described as a "sleeve valve" having an annular skirt or sleeve with sealing surfaces to impede air flow over a circumferential valve seat from discharge slots in the compressor flow path. Conventional sleeve-type valve assemblies include a bellcrank mechanism to axially translate the sleeve between open and closed positions. The conventional sleeve valve arrangement is very reliable, distributes air flow more uniformly and is compact. Such valves require an external hydraulic actuator and are mechanically complex due to a plurality of bellcrank actuators that are necessary about the periphery of the sleeve to provide uniform valve operation.

Sleeve-type valves require relatively short stroke movement of the valve plug in order to release substantial volumes of air from the compressor airpath. In contrast, individual pneumatically operated compressor bleed valves are often provided in multiples since they are capable of exhausting a relatively small air flow volume. A major disadvantage of the pneumatic compressor bleed valves conventionally used is that the pistons of the valves are usually guided by a single central pin or shaft or by the side walls of the piston itself. The radially operating valve pistons are subjected to substantial side loads from axially directed air flows which induces friction and over time reduces the response rate of the valve due to frictional wear.

It is an object of the present invention to provide a mechanically simple lightweight pneumatically operated sleeve type bleed valve that eliminates reliance on multiple individual activated valves or bulky external mechanical actuators.

It is a further object of the invention to provide a sleeve-type valve that is subjected to axial loads parallel to its operating direction and thereby eliminates detrimental side loading problems of the prior art.

Further objects of the invention will be apparent from review of the disclosure, drawings and description of the invention below.

DISCLOSURE OF THE INVENTION

The invention provides a pneumatically operated bleed valve in a containment housing, such as an axial or centrifugal compressor housing and exhausting to a bypass duct of a gas turbine engine, for example. The valve has an annular piston slidably mounted within an annular chamber concentric the longitudinal engine axis. An annular valve plug on the piston and an annular valve seat on the compressor housing defining a valve seal interface. A control air pressure conduit communicates between a portion of the annular chamber bounded by the piston and a source of control air pressure. Guide bearings mounted to the periphery of the piston and the housing have a helical guide surface concentric the engine axis The result is a sleeve-type pneumatically actuated compressor bleed valve that is lightweight, compact and reliable due to simple axial actuation using an annular chamber with annular piston sealed therein. The piston is guided axially in a helical pattern with three supporting bearings and includes a skirt serving as a valve plug to engage a mating conical valve seat. The valve plug includes variable area orifices to permit a gradual increase and decrease to the volume of flow and flow resistance of the valve assembly.

An advantage of the annular valve plug and skirt is the ability to permit passage of a high volume of compressed air with very little axial motion due to the large peripheral or circumferential surface area that can be exposed, relative to individual pneumatically operated valves of the prior art. Guiding of the axial motion of the annular piston with three bearings in helical tracks provides stability to the piston and eliminates side loading since the major forces acting on the piston are axially oriented.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
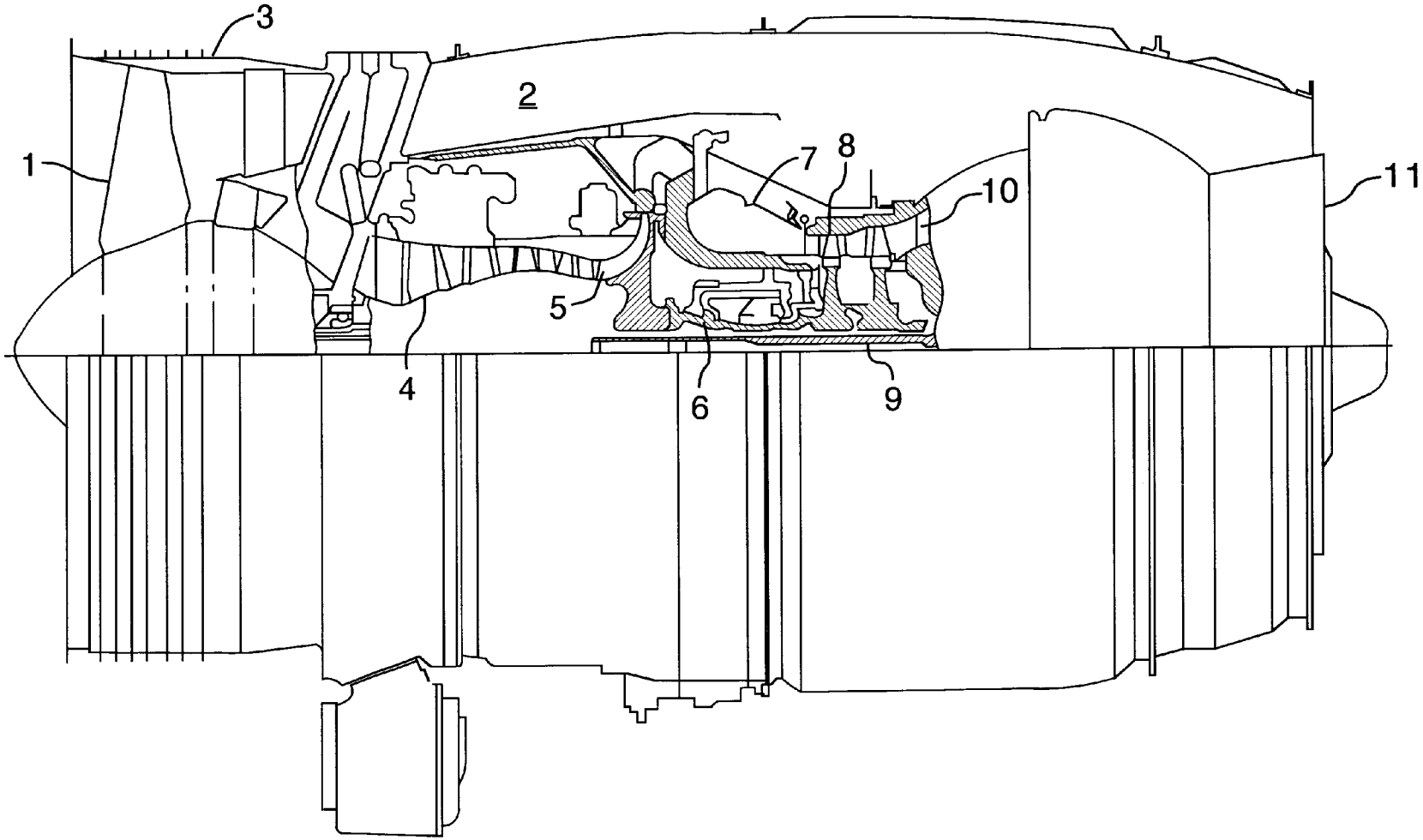
FIG. 1 is a longitudinal cross-sectional view through one example of a gas turbine engine showing coaxial low pressure and high-pressure shafts, and showing the typical disposition of the centrifugal compressor and surrounding impeller shroud housing.

FIG. 1 shows a longitudinal cross-sectional view through an example gas turbine engine. Air passes through the engine (from left to right as drawn) first passing fan 1 and then splitting into two flows of air. An outer portion of the air flow passes through the bypass duct 2 formed by the annular fan case assembly 3 and an inner portion passes through the engine core past the low pressure compressor stage 4. In the example shown, the .engine includes a high pressure centrifugal compressor 5 mounted to a high pressure shaft 6 and driven by hot gas passing from the combustor 7 over high pressure turbine rotors 8. The fan 1 and low-pressure compressor 4 are mounted to a low-pressure shaft 9 driven by low-pressure turbine rotors 10. Gas is exhausted through the exhaust mixer 11 after passing the low-pressure rotors 10.

Figure 2:
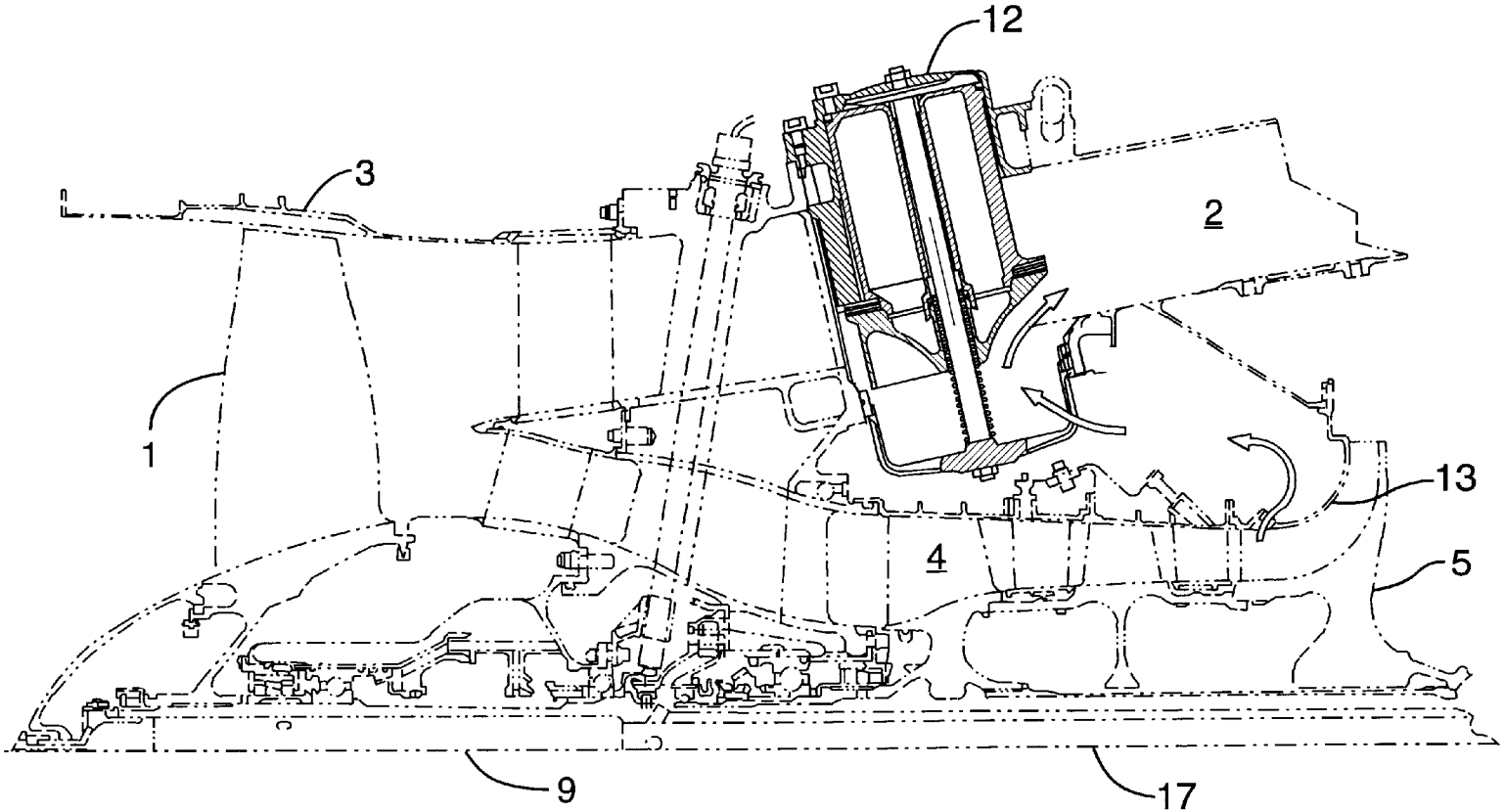
FIG.2 (Prior Art)
FIG. 2 is a detail longitudinal cross-sectional view through a prior art centrifugal compressor and impeller shroud housing, with a conventional pneumatic piston compressor bleed valve communicating between the compressor flow path and the bypass flow path.

Of particular interest to the present invention is the design of compressor bleed valves. FIG. 2 shows a prior art pneumatically operated compressor bleed valve 12 in an open position. The valve 12 permits removal of a portion of the compressed air from the compressor flow path through a series of radial flow ports (as indicated by arrows) and exhausts the compressed air into the bypass duct 2. The central shaft and piston of this prior art bleed valve 12 are subjected to substantial lateral or side loads due to the reversal of air flow direction and orientation of the inlet and outlet ports. The valve plug face is contoured to direct flow laterally into the bypass duct 2. The limited volume of air that can be directed through such bleed valves 12 requires multiple units that obstruct the bypass duct 2. Further the valves 12 introduce flow instabilities when the compressed air is introduced at valve locations within the bypass duct 2, rather than more uniformly diffused at many locations that are possible when a sleeve type valve is used.

Figure 3:
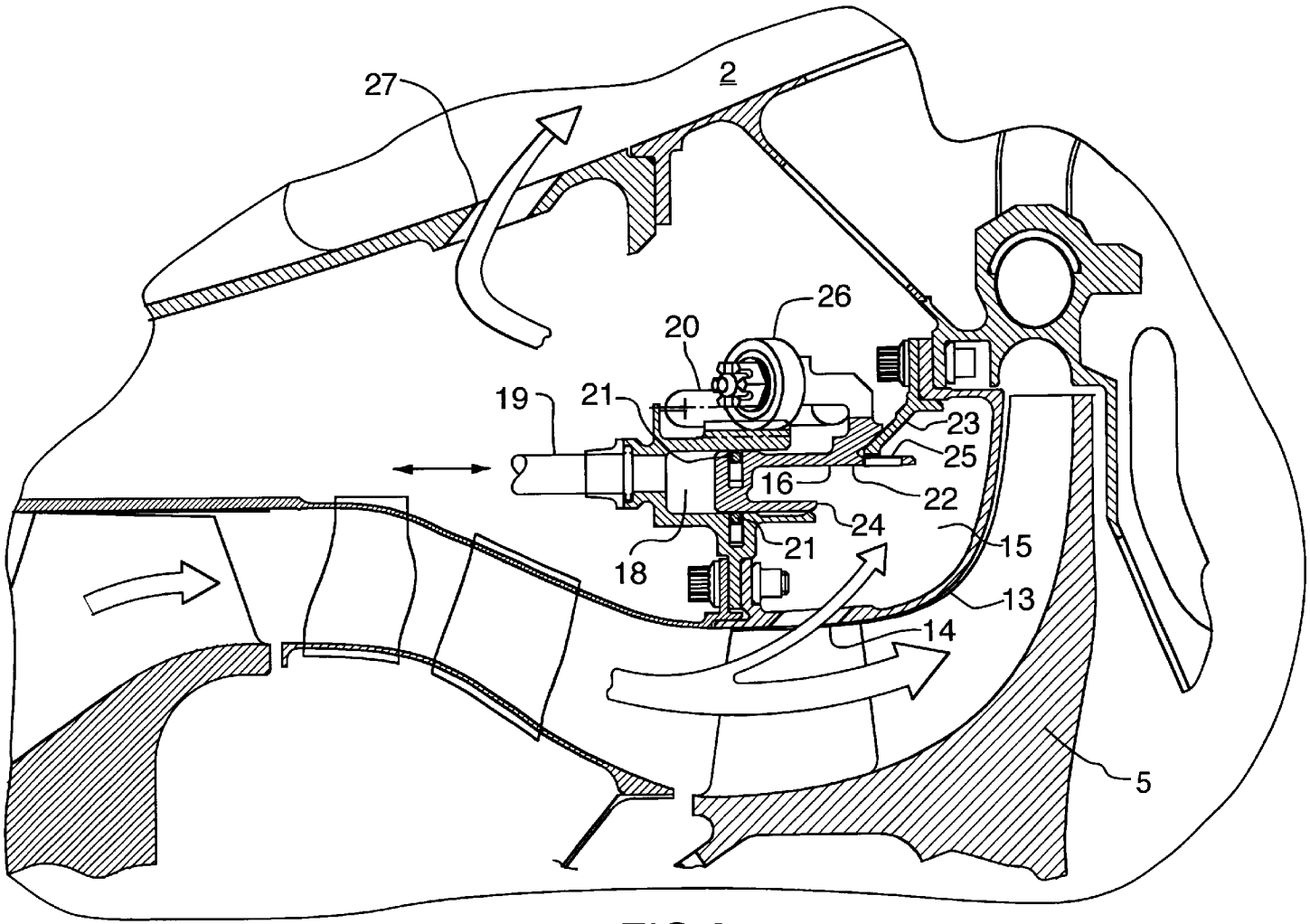
FIG. 3 is a comparable detail longitudinal cross-sectional view through a centrifugal compressor and impeller shroud housing, with a sleeve type pneumatic piston compressor bleed valve according to the invention.

FIG. 3 shows a pneumatically operated sleeve type compressor bleed valve in accordance with the invention. The compressor bleed valve in the illustrated example communicates with air flow in the compressor housing 13 and with the bypass duct 2 of the gas turbine engine through compressor discharge air slots 14. The compressor housing 13 is radially symmetrical about the longitudinal engine axis 17 and slots 14 provided at multiple locations with multiple exit slots 27 in the bypass duct 2 results in an improved uniform annular air flow path.

As indicated with arrows, the compressed air exits the compressor housing 13 through slots 14 and enters the compressor discharge air chamber 15 where it is confined if the valve piston 16 remains in the closed position that is shown in FIG. 3. The annular piston 16 is slidably mounted for axial motion within an annular chamber 18 and both are concentric the longitudinal engine axis 17. A control air pressure conduit 19 communicates between a portion of the annular chamber 18 bounded by the head of the piston 16 and a source of controlled air pressure (not shown) to axially move the piston 16 between the closed position shown in FIG. 3 and an open position. In the open position, air pressure is released from the chamber 18 and the pressure in the chamber 15 together with the force of springs 20 draw the piston 16 to an open position (towards the left decreasing the size of chamber 18 in FIG. 3). Piston sealing rings 21 maintain an air pressure seal between chambers 18 and 15, and ensure smooth sliding operation. The major forces exerted on the piston 16 are axial although air flow exerts some radial drag load and pressure on the conical sealing surface as it passes through. The alignment and the stability of the piston 16 during operation are achieved by the guide bearings 26 running within helical slots. The springs 20 will also ensure that the valve is at the open position during engine start up or in the event of system failure.

The piston includes an annular valve plug 22 that in the preferred embodiment shown has a conical valve seal interface mating the conical valve seat 23 mounted on the compressor housing 13. The valve plug 22, as illustrated, comprises a cylindrical skirt about the periphery of the piston 16. To maintain alignment and minimize weight, the piston 16 may also include an auxiliary skirt 24.

About the periphery of the cylindrical skirt of the valve plug 22 is a series of orifices 25 that preferably have a variable area to expose a large variable area to airflow when the piston and valve plug 22 slide axially. The orifices for example may have a triangular shape, a teardrop shape or helical asymmetrical shape for example.

It will be understood that the pressurization of chamber 18 with control air from conduit 19 to a large extent is self-equalizing since air pressure is uniformly distributed throughout the annular chamber 18 resulting in uniform pressure on the piston head 16. Further, the auxiliary skirt 24 and valve plug 22 have sliding cylindrical alignment surfaces on adjacent portions of the compressor housing 13 to maintain axial alignment when the piston is moved between the closed and the open position.

Due to the speed of air flow through orifices 25, possible rotation of the piston 16 must be restrained to prevent airflow impedance, excessive seal wear and alignment difficulties. As a result the invention provides preferably three guide bearings 26 mounted spaced about the periphery of the piston. The guide bearings 26 run in a helical track guide surface concentric to the axis 17.

It will be understood that the invention is not restricted to the example described above but may be incorporated into many other applications where an annular valve is of advantage, such as about axial compressors, to control gas flow about turbines, into gas inlets or from exhausts. An annular fluid valve operated pneumatically or hydraulically can also be applied to fluid pump housings, large diameter valves, impeller housings, rotary turbine housings, flues, fuel-air mixing tubes and other ducts that convey and control fluid flow.

Although the above description relates to a specific preferred embodiment as presently contemplated by the inventor, it will be understood that the invention in its broad aspect includes mechanical and functional equivalents of the elements described herein.

We claim:

1. A pneumatically operated compressor bleed valve communicating between a compressor housing and a bypass duct of a gas turbine engine, the housing having a longitudinal engine axis and a radial surface of revolution about the axis, the valve comprising:

an annular piston slidably mounted within an annular chamber concentric the longitudinal axis;

an annular valve plug on the piston and an annular valve seat on the compressor housing defining a valve seal interface; and a control air pressure conduit communicating between a portion of the annular chamber bounded by the piston and a source of control air pressure.

2. A valve according to claim 1 wherein the valve plug comprises a cylindrical skirt with a plurality of orifices disposed about a periphery thereof.

3. A valve according to claim 2 wherein the orifices expose a variable area to air flow when the piston and valve plug slide axially.

4. A valve according to claim 1 wherein the piston and chamber slidably engage with sealing rings.

5. A valve according to claim 1 comprising:

a plurality of guide bearings mounted to a periphery of the piston and the housing, the bearings having a helical guide surface concentric the axis.

6. A valve according to claim 1 wherein the valve seat and valve plug comprise mating conical surfaces.

7. A valve according to claim 1 wherein the valve plug is spring biased to an open position.

8. A gas turbine engine having a longitudinal engine axis, a compressor housing with a radial surface of revolution about the axis and a bypass duct, the engine comprising:

a pneumatically operated compressor bleed valve communicating between of the compressor housing and the bypass duct, comprising:

an annular piston slidably mounted within an annular chamber concentric the longitudinal axis;

an annular valve plug on the piston and an annular valve seat on the compressor housing defining a valve seal interface; and a control air pressure conduit communicating between a portion of the annular chamber bounded by the piston and a source of control air pressure.

9. An engine according to claim 8 wherein the valve plug comprises a cylindrical skirt with a plurality of orifices disposed about a periphery thereof.

10. A valve according to claim 9 wherein the orifices expose a variable area to air flow when the piston and valve plug slide axially.

11. A valve according to claim 8 wherein the piston and chamber slidably engage with sealing rings.

12. A valve according to claim 8 comprising:

a plurality of guide bearings mounted to a periphery of the piston and the housing, the bearings having a helical guide surface concentric the axis.

13. A valve according to claim 8 wherein the valve seat and valve plug comprise mating conical surfaces.

14. A valve according to claim 8 wherein the valve plug is spring biased to an open position.

* * * * *